US007391987B2

(12) United States Patent
Sahara

(10) Patent No.: US 7,391,987 B2
(45) Date of Patent: Jun. 24, 2008

(54) IMAGE FORMING APPARATUS WHICH USES A PLURALITY OF HEAT-FIXING DEVICES

(75) Inventor: Hiroshi Sahara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 74 days.

(21) Appl. No.: 11/202,229

(22) Filed: Aug. 12, 2005

(65) Prior Publication Data

US 2006/0039716 A1 Feb. 23, 2006

(30) Foreign Application Priority Data

Aug. 20, 2004 (JP) ..... 2004-240904

(51) Int. Cl.
*G03G 21/20* (2006.01)

(52) U.S. Cl. ..... 399/92; 399/94

(58) Field of Classification Search ..... 399/320–342, 399/67–70; 219/216
See application file for complete search history.

(56) References Cited

U.S. PATENT DOCUMENTS

| | | | | |
|---|---|---|---|---|
| 6,118,956 | A * | 9/2000 | Hirao | 399/85 |
| 6,324,358 | B1 | 11/2001 | Sahara | 399/66 |
| 6,714,229 | B2 * | 3/2004 | Miyazaki et al. | 347/223 |
| 6,775,492 | B2 * | 8/2004 | Miyakoshi et al. | 399/92 |
| 6,996,362 | B2 * | 2/2006 | Kellie et al. | 399/328 |
| 7,020,431 | B2 | 3/2006 | Sahara | 399/400 |

FOREIGN PATENT DOCUMENTS

| | | | |
|---|---|---|---|
| JP | 56104364 | A * | 8/1981 |
| JP | 3-75772 | | 3/1991 |
| JP | 4-155370 | | 5/1992 |
| JP | 7-271226 | | 10/1995 |
| JP | 11-38819 | | 2/1999 |
| JP | 11-95641 | | 4/1999 |
| JP | 2002062771 | A * | 2/2002 |
| JP | 2004-85906 | | 3/2004 |

* cited by examiner

*Primary Examiner*—David M Gray
*Assistant Examiner*—Erika J. Villaluna
(74) *Attorney, Agent, or Firm*—Fitzpatrick, Cella, Harper & Scinto

(57) ABSTRACT

An image forming apparatus which uses a plurality of heat-fixing devices, and secures a fixing property and a high quality of image and on the other hand, suppresses electric power consumption and further, curtails the number of parts, and gives consideration to an environment and realizes a lower cost. The image forming apparatus includes an image forming portion which forms a toner image on a recording medium, and first and second fixing devices which heat-fix the toner image formed on the recording medium, and an exhaust heat route from the first fixing device passes via the second fixing device.

4 Claims, 3 Drawing Sheets

IMAGE FORMING APPARATUS WHICH USES A PLURALITY OF HEAT-FIXING DEVICES

BACKGROUND OF THE INVENTION

1. Field of the Invention

The invention relates to an image forming apparatus such as, for example, a copying machine, a printer or a facsimile apparatus which adopts image forming process means of an electrostatic recording type, an electrophotographic recording type or the like, forms an unfixed toner image on a recording medium such as a sheet by a transferring process or a direct process, fixes the unfixed toner image formed on the recording medium as a permanently fixed image on the recording medium by heat-fixing means and outputs the image-formed article.

2. Related Background Art

There has heretofore been proposed an image forming apparatus provided with a plurality of heat-fixing devices as heat-fixing means. There is also an image forming apparatus which tentatively fixes a toner transferred onto a transfer material on the transfer material at a low temperature by the utilization of a plurality of heat-fixing devices differing in fixing temperature from one another, and thereafter regularly fixes the tentatively fixed toner on the transfer material at a high temperature (see Japanese Patent Application Laid-Open No. H03-75772). According to the image forming apparatus adopting such construction, various image conditions such as a line image and image density are not adversely affected, and the toner transferred onto the transfer material can be sufficiently fixed, and an image of high fixing strength and high quality has become obtainable.

However, in a case where the plurality of heat-fixing devices as previously described are disposed, there has been pointed out the problem that the use of the plurality of heat-fixing devices which are originally high in electric power consumption leads to a great increase in consumed electric power in the entire image forming apparatus. Also, a plurality of heat exhaust means for exhausting hot air produced by the heat-fixing devices become necessary so that the interior of the image forming apparatus may not be filled with the hot air. Further, the amount of heat to be exhausted also increases.

SUMMARY OF THE INVENTION

So, it is an object of the present invention to provide an image forming apparatus which uses a plurality of heat-fixing devices and secures a fixing property and a high quality of image and on the other hand, suppresses electric power consumption and further, curtails the number of parts, and gives consideration to an environment and realizes a lower cost.

An image forming apparatus according to the present invention has an image forming portion which forms a toner image on a recording medium, and first and second fixing devices which heat-fix the toner image formed on the recording medium.

The above and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

The present invention will hereinafter be described more specifically with respect to some embodiments thereof. These embodiments are examples of the best embodiments of the present invention, but the present invention is not restricted to these embodiments.

Embodiment 1

(1) Schematic Description of an Embodiment of the Image Forming Apparatus

Figure 1:
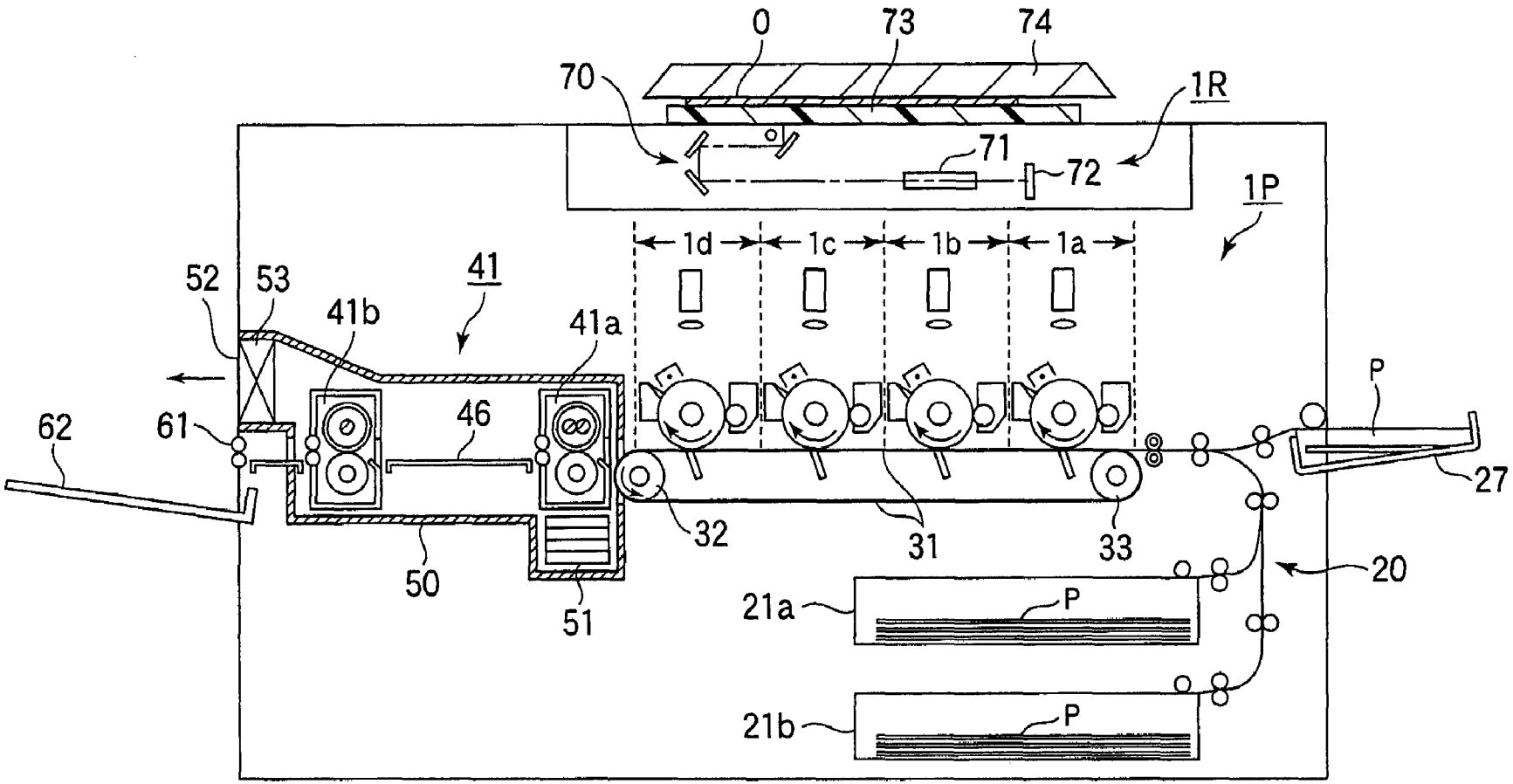
FIG. 1 is a schematic cross-sectional view of an image forming apparatus according to Embodiment 1.

FIG. 1 schematically shows the construction of an image forming apparatus according to a first embodiment of the present invention. This image forming apparatus is a full-color copying machine of an electrophotographic type and an in-line type.

A reader portion 1R disposed on the upper surface side of an image forming apparatus main body color-separates and photoelectrically reads the image of a color original to be copied. This reader portion 1R comprises an original glass stand 73, an original pressure cover 74, a scanning portion 70 having an original illuminating lamp and a movable mirror, an optical lens system 71, a solid state image pickup element (CCD) 72, etc. The color original O to be copied is placed on the original glass stand with its image surface facing down in a accordance with a predetermined placement standard, and is covered with the original pressure cover 74. In the scanning portion 70, the operation of applying light to the downwardly facing image surface of the original O on the original glass stand 73 and scanning the image surface by an image formation starting signal is performed. Original surface scanning light (reflected light from the original) is inputted to the CCD 72 through the optical lens system 71, and is color-separated and photoelectrically read. The color-separated and photoelectrically read electrical signal is inputted to the exposing devices of the first to fourth image forming portions of a printer portion which will now be described. In some cases, the original pressure cover 74 is replaced with an automatic document feeder (ADF or RDF).

The printer portion (an image forming process means portion which forms an unfixed toner image on a transfer material as a recording medium) 1P in the image forming apparatus main body is provided with four image forming portions (image forming units), i.e., a first image forming portion 1*a* which forms a yellow image, a second image forming portion 1*b* which forms a magenta image, a third image forming portion 1*c* which forms a cyan image, and a fourth image forming portion 1*d* which forms a black image, and these four image forming portions 1*a*, 1*b*, 1*c* and id are arranged in a row at predetermined intervals.

Figure 2:
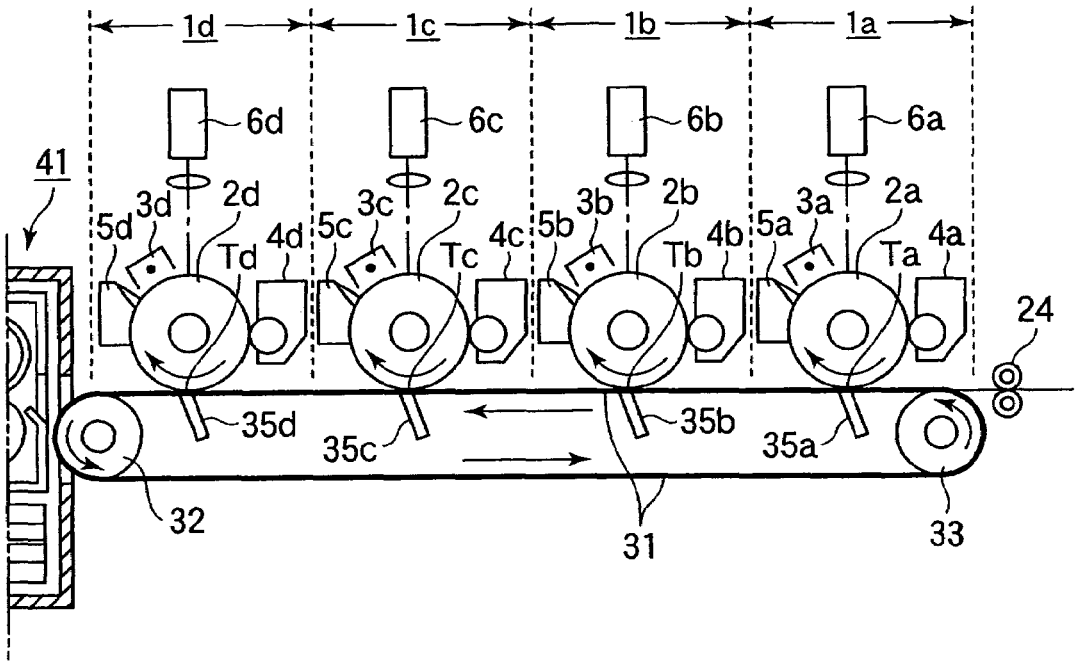
FIG. 2 is an enlarged view of first to fourth image forming portions in the image forming apparatus of FIG. 1.

FIG. 2 is an enlarged view of the first to fourth image forming portions 1*a*, 1*b*, 1*c* and 1*d* in the image forming apparatus of FIG. 1. Referring to FIG. 2, drum-shaped electrophotographic photosensitive members (hereinafter referred to as the photosensitive drums) 2*a*, 2*b*, 2*c* and 2*d* as image bearing members are installed in the image forming portions 1*a*, 1*b*, 1*c* and 1*d*, respectively. Around the respective photosensitive drums 2*a*, 2*b*, 2*c* and 2*d*, there are installed chargers 3*a*, 3*b*, 3*c* 3*d*, developing devices 4*a*, 4*b*, 4*c*, 4*d* and drum cleaning devices 5*a*, 5*b*, 5*c* and 5*d*. A yellow toner, a magenta toner, a cyan toner and a black toner are contained in the developing devices 4*a*, 4*b*, 4*c* and 4*d*, respectively. Also, in the respective image forming portions 1*a*, 1*b*, 1*c* and 1*d*, exposing devices 6*a*, 6*b*, 6*c* and 6*d* are installed between and above the chargers 3 and the developing devices 4.

Each of the photosensitive drums 2*a*, 2*b*, 2*c* and 2*d* is a negatively charged organic photoconductive (OPC) photosensitive member having a photoconductive layer on a drum base made of aluminum, and is rotatively driven at a predetermined process speed in the direction indicated by the arrow (counter-clockwise direction) by a driving device (not shown). The chargers 3*a*, 3*b*, 3*c* and 3*d* as charging means uniformly charge the surfaces of the respective photosensitive drums 2*a*, 2*b*, 2*c* and 2*d* to predetermined potential of the negative polarity by a charging bias applied thereto from a charging bias voltage source (not shown).

The developing devices 4*a*, 4*b*, 4*c* and 4*d* cause toners of respective colors to adhere to electrostatic latent images formed on the respective photosensitive drums 2*a*, 2*b*, 2*c* and 2*d* to thereby develop (visualize) the electrostatic latent images as toner images. As the developing method by the developing devices 4*a*, 4*b*, 4*c* and 4*d*, use can be made, for example, of dual-component contact development using a mixture of toner particles and a carrier as a developer, and carrying the developer by a magnetic force, and developing the electrostatic latent images in a contact state with the respective photosensitive drums 2*a*, 2*b*, 2*c* and 2*d*.

Transfer blades 35*a*, 35*b*, 35*c* and 35*d* as transferring means in the image forming portions 1*a*, 1*b*, 1*c* and 1*d* are each constituted by an elastic member, and about against the respective photosensitive drums 2*a*, 2*b*, 2*c* and 2*d* in the nip portions of the transferring portions Ta, Tb, Tc and Td of the respective image forming portions with an endless-belt-shaped transfer material conveying belt (hereinafter referred to as the transfer belt) 31 interposed therebetween.

While herein the transfer blades 35 are used as the transferring means, use may be made of transfer rollers to which a high voltage is applied when the toner images are transferred to the transfer material and which contact with the transfer belt 31.

The drum cleaning devices 5*a*, 5*b*, 5*c* and 5*d* remove and collect any untransferred toners residual on the surfaces of the photosensitive drums 2*a*, 2*b*, 2*c* and 2*d* by blade members.

The exposing devices 6*a*, 6*b*, 6*c* and 6*d* output from a laser outputting portion (not shown) a laser beam modulated correspondingly to the time-serial electrical digital pixel signal of color-separated image information inputted from the aforedescribed reader portion 1R, and expose the surfaces of the photosensitive drums 2*a*, 2*b*, 2*c* and 2*d* to the laser beam through a polygon mirror (not shown) or the like rotated at a high speed. Thereby, electrostatic latent images of a pattern conforming to the color-separated image information of each color are formed on the surfaces of the respective photosensitive drums 2*a*, 2*b*, 2*c* and 2*d* charged by the chargers 3*a*, 3*b*, 3*c* and 3*d*.

The transfer belt 31 is passed over a drive roller 32 and a tension roller 33, and is rotated (moved) in the direction indicated by the arrow (counter-clockwise direction) by the driving of the drive roller 32. The transfer belt 31 is formed of dielectric material resin such as polycarbonate, polyethylene terephthalate resin film or polyvinylidene fluoride resin film.

Also, a tandem fixing unit 41 having first and second heat-fixing portions (fixing devices) 41*a* and 41*b* is disposed downstream of the transfer belt 31 with respect to a transfer material conveying direction. This tandem fixing unit 41 will be described in detail in item (2) below.

The image forming operation of the above-described image forming apparatus will now be described with reference to FIG. 1. When the image formation starting signal is produced, the photoelectric reading of an original image is executed in the reader portion 1R. Also, in the printer portion 1P, the photosensitive drums 2*a*, 2*b*, 2*c* and 2*d* of the first to fourth image forming portions 1*a*, 1*b*, 1*c* and 1*d* are rotatively driven at a predetermined process speed. Then, the photosensitive drums are uniformly charged to the negative polarity by the chargers 3*a*, 3*b*, 3*c* and 3*d*, respectively. Then, the exposing devices 6*a*, 6*b*, 6*c* and 6*d* convert the color-separated image signals of the original O inputted from the reader portion 1R into optical signals by the laser outputting portion (not shown), and laser beams which are the converted optical signals scan and expose the charged photosensitive drums 2*a*, 2*b*, 2*c* and 2*d* to thereby form electrostatic latent images thereon.

Then, the yellow toner is first caused to adhere to the electrostatic latent image formed on the photosensitive drum 2*a* of the first image forming portion 1*a* by the developing device 4*a* to which has been applied a developing bias of the same polarity as the charging polarity (negative polarity) of the photosensitive drum 2*a*, thereby visualizing the electrostatic latent image as a toner image.

Then, in accordance with the timing at which the leading edge of the toner image on the photosensitive drum 2*a* is moved to the transferring portion Ta between the photosensitive drum 2*a* and the transfer blade 5*a*, a transfer material (paper) P selectively fed from a first sheet supply cassette 21*a* or a second sheet supply cassette 21*b* or a manually feeding cassette 27 through a transfer material conveying portion 20 is conveyed to the transferring portion Ta by registration rollers 24. Then, the yellow toner image on the photosensitive drum 2*a* is transferred onto the transfer material P conveyed to the transferring portion Ta by the transfer blade 35*a* to which a transfer bias (of the opposite polarity (positive polarity) to the toner) has been applied.

The transfer material P to which the yellow toner image has been transferred is moved to the second image forming portion 1*b* by the transfer material conveying belt 31. Then, again in a transferring portion Tb constituted by this image forming portion 1*b* and the transfer blade 35*b*, a magenta toner image formed on the photosensitive drum 2*b* in the same manner as previously described is superposed on the yellow toner image on the transfer material P and is transferred.

Thereafter, in the same manner, cyan and black toner images formed on the photosensitive drum 2*c* and 2*d* of the third and fourth image forming portions 1*c* and id, respectively, are successively superposed on the yellow and magenta toner images superposedly transferred onto the transfer material P, in transferring portions Tc and Td, whereby a full-color toner image is formed on the transfer material P.

The transfer material P on which the full-color toner image has been formed is conveyed to the tandem fixing unit 41, where it is subjected to the heat-fixing of the toner image, and is discharged as a full-color image-formed article onto a sheet discharging tray 62.

Any untransferred toners residual on the photosensitive drums 2*a*, 2*b*, 2*c* and 2*d* when the above-described images have been transferred from the photosensitive drums to the transfer material are removed and collected by the drum cleaning devices 5*a*, 5*b*, 5*c* and 5*d*.

(2) Tandem Fixing Unit 41

Figure 3:
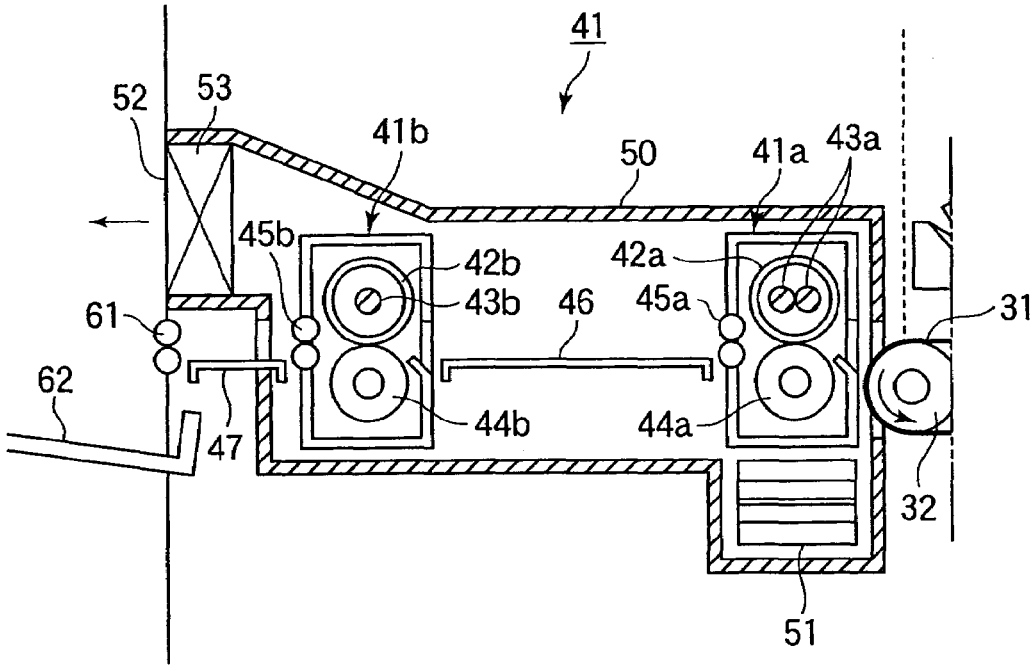
FIG. 3 is an enlarged view of a tandem fixing unit portion in the image forming apparatus of FIG. 1.

FIG. 3 is an enlarged view of the tandem fixing unit 41 portion in the image forming apparatus of FIG. 1. This tandem fixing unit 41 has a first heat-fixing portion 41*a* (hereinafter referred to as the first heat-fixing device) installed near the downstream side of the transfer material conveying belt 31 with respect to the transfer material conveying direction, and a second heat-fixing portion 41*b* (hereinafter referred to as the second heat-fixing device) installed further downstream of the first heat-fixing device 41*a*. In the present embodiment, both of the first and second heat-fixing devices 41*a* and 41*b* are heat roller fixing devices. A transfer material conveying guide 46 is disposed between the first heat-fixing device 41*a* and the second heat-fixing device 41*b*.

The transfer material P bearing the unfixed toner images thereon conveyed to the tandem fixing unit 41 by the transfer material conveying belt 31 is first subjected to a toner image tentatively fixing process by the heat and pressure action of the first heat-fixing device 41*a*. Then, it is subjected to a tentatively fixed toner completely fixing process by the heat and pressure action of the second heat-fixing device 41*b*.

a) First Heat-Fixing Device 41*a*

The first heat-fixing device 41*a* has a heating roller (fixing roller) 42*a*, a pressure roller 44*a* and a fixing sheet discharge roller 45*a*.

The heating roller 42*a* has its mandrel formed of a metallic material such as aluminum or iron. The thickness (desirably 0.3 to 10 mm) and outer diameter (desirably 30 to 100 mm) of the mandrel are appropriately set. Also, the surface of the heating roller 42*a* is coated with fluoroplastic in order to prevent the toners from adhering to the surface.

On the other hand, the pressure roller 44*a* is comprised of a mandrel and a rubber portion. The outer diameter (desirably 10 to 100 mm) of the mandrel, the thickness (desirably 2 to 30 mm) of the rubber portion and the hardness (desirably 40 to 90°) of the rubber are appropriately set. Also, the pressure roller is brought into pressure contact with the heating roller 42*a* by the spring force (desirably 5 to 300 kg) of a pressure spring (not shown) to thereby form a fixing nip portion of a predetermined width between the pressure roller and the heating roller 42*a*.

In the interior of the heating roller 42*a*, there is disposed a halogen heater 43 extending in the longitudinal direction thereof, and the heating roller 42*a* is heated by the generated heat of this halogen heater 43. The heating roller 42*a* has its surface temperature-controlled to a predetermined fixing temperature by a temperature controlling system (not shown) (150 to 250° C. is desirable on the surface of the heating roller 42*a*).

The transfer material P bearing the unfixed toner images thereon conveyed by the transfer material conveying belt 31 is nipped and conveyed by the fixing nip portion between the heating roller 42*a* and the pressure roller 44*a*, and by the heat and pressure action therebetween, the unfixed toner images are tentatively fixed on the transfer material P.

In some cases, in order to secure a predetermined amount of heat, as shown in FIG. 3, two halogen heaters 43*a* are arranged in parallel. Further, not a halogen heater, but other heat source (e.g. a heating device by a magnetic induction heating method or the like) may be utilized.

b) Second Heat-Fixing Device 41*b*

The second heat-fixing device 41*b* is a heat roller fixing device substantially similar to the above-described first heat-fixing device 41*a*, and has a heating roller (fixing roller) 42*b*, a pressure roller 44*b* and a fixing sheet discharge roller 45*b*. However, the amount of generated heat of a heat source 43*b* (in FIG. 3, a halogen heater) in the interior of the heating roller 42*b* is set so as to be small as compared with the amount of generated heat of the heat source 43*a* of the first heat-fixing device 41*a*. For example, the amount of generated heat of the heat source 43*a* of the first heat-fixing device 41*a* is 1,000 W (as shown in FIG. 3, the number of halogen heaters in the heating roller 42*a* is two: 500 W×2=1,000 W), whereas the amount of generated heat of the heat source 43*b* of the second heat-fixing device 41*b* is set to 500 W (the number of halogen heaters in the heating roller 42*b* is one: 500 W×1=500 W).

The amounts of generated heat of the first and second heat fixing devices 41*a* and 41*b* must be appropriately set depending on the specification thereof and the disposition thereof in the image forming apparatus, but it is desirable that the amount of generated heat of the first heat-fixing device 41*a* which is great in the amount of generated heat be set within a range of 500 to 2,000 W, and the amount of generated heat of the second heat-fixing device 41*b* which is small in the amount of generated heat be set within a range of 50 to 1,000 W.

The transfer material P subjected to the tentative fixing of the toner images in the first heat-fixing device 41*a* is conveyed to the second heat-fixing device 41*b* by the fixing sheet discharge roller 45*a* and a transfer material conveying guide 46, and is nipped and conveyed by the fixing nip portion between the heating roller 42*b* and pressure roller 44*b* of this second heat-fixing device 41*b*, and by the heat and pressure action therebetween, the tentatively fixed toner images on the transfer material P are completely fixed.

The transfer material P subjected to the complete fixing of the toner images by the second heat-fixing device 41*b* is discharged onto the sheet discharging tray 62 by a pair of sheet discharging rollers 45*b*, a conveying guide 47 and a pair of outer sheet discharging rollers 61.

The above-described first heat-fixing device 41*a* and second heat-fixing device 41*b* are included in a heat exhaust duct 50 as an exhaust heat route for exhausting hot air (hereinafter referred to as the fixing hot air) coming out therefrom. Near the first heat-fixing device 41*a* in this heat exhaust duct 50, there is disposed an intake opening 51 for sucking the atmosphere, and near the second heat-fixing device 41*b* in the heat exhaust duct 50, there is provided a heat exhaust opening (exhaust opening) 52 for exhausting the fixing hot air coming out from the first heat-fixing device 41*a* and the second heat-fixing device 41*b* to the outside of the image forming apparatus. Further, a heat exhaust fan 53 is provided in the heat exhaust opening 52, and strongly assists a series of operations of introducing the atmosphere through the intake opening 51 and exhausting heat through the heat exhaust opening 52.

According to the present construction the intake opening 51 in the heat exhaust duct 50 communicates with the heat exhaust opening 52 by the exhaust heat fan 53 and therefore, the fixing hot air produced by the first heat-fixing device 41*a* arrives at the second heat-fixing device 41*b* along the interior of the heat exhaust duct 50. As previously described, the first heat-fixing device 41*a* assumes a high temperature of 150 to 250° C. and therefore, the air around this first heat-fixing device 41*a* also has heat of 70 to 100° C. as the fixing hot air, and further, the first heat-fixing device 41*a* is substantially hermetically sealed by the heat exhaust duct 50 and therefore, the fixing hot air around the first heat-fixing device 41*a* arrives at the second heat-fixing device 41*b* by the ventilation in the heat exhaust duct 50 almost without any loss. Thus, the second heat-fixing device 41*b* is disposed in the hot air of 70 to 100° C. produced by the first heat-fixing device 41*a*, and the amount of generated heat necessary for the second heat-fixing device 41*b* to reach a predetermined temperature (desirably 100 to 200° C.) can be suppressed to at least a half of that for the first heat-fixing device 41*a*.

That is, the exhaust heat route (heat exhaust duct) 50 for the fixing hot air of the first heat-fixing device 41*a* is designed to pass via the second heat-fixing device 41*b*, and to exhaust the fixing hot air of the first heat-fixing device 41*a* and second heat-fixing device 41*b* in one and the same exhaust heat route 50 through one and the same heat exhaust opening 52.

As described above, the hot air by the heat generation of one heat-fixing device 41*a* is utilized for the heat generation of the other heat-fixing device 41*b*, whereby a plurality of (in the present embodiment, two) heat-fixing devices are used and yet, the consumed electric power required for the heat generation of the heat-fixing devices can be suppressed to a low level and also, in the heat-fixing device 41*b* receiving the hot air, the heat generating device concerned in heat generation can be constructed on a small scale.

Also, the heat exhaust of the first heat-fixing device 41*a* and the second heat-fixing device 41*b* is effected by one and the same heat exhaust duct 50 and therefore, it is not necessary to provide a heat exhaust duct for each of the first and second heat-fixing devices, and this contributes to a decrease in the number of parts, the simplification of the layout of the interior of the image forming apparatus and the downsizing of the image forming apparatus.

Moreover, the utilization of the exhaust heat of one heat-fixing device 41*a* assists the temperature control of the other heat-fixing device 41*b* and therefore, the amount of heat exhausted from the image forming apparatus is relatively small, and this leads to the effect that the environment around the image forming apparatus is not aggravated.

If a suction fan is also disposed near the intake opening 51 of the heat exhaust duct 50 constituting the exhaust heat route, ventilation can be done more effectively and the heat transfer to the second heat-fixing device 41*b* downstream in the heat exhaust duct 50 with respect to the ventilation is effected actively and therefore, electric power consumption can be suppressed.

Embodiment 2

Figure 4:
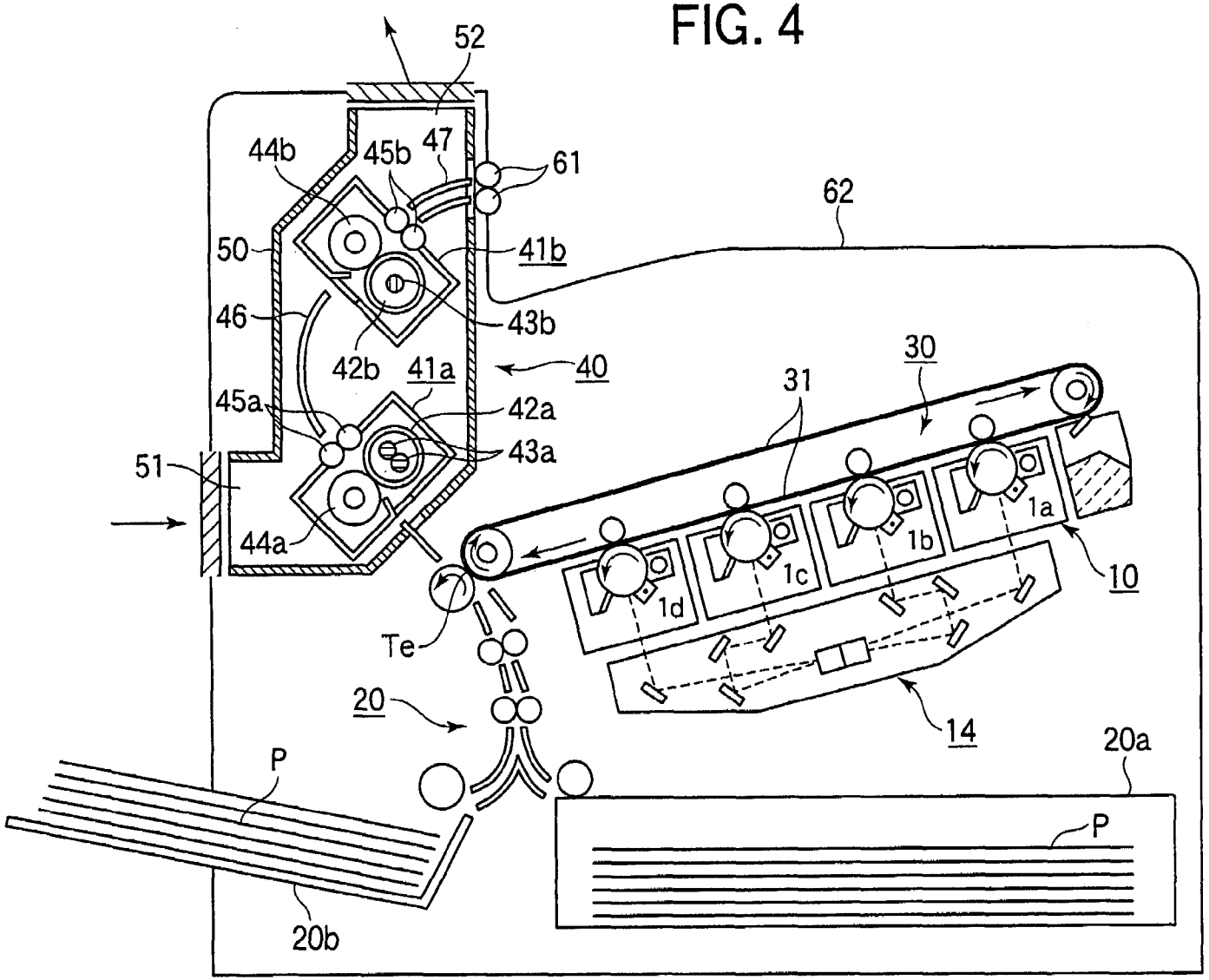
FIG. 4 is a schematic cross-sectional view of an image forming apparatus according to Embodiment 2.

FIG. 4 schematically shows the construction of an image forming apparatus according to Embodiment 2 of the present invention. This image forming apparatus is a full-color copying machine of an electrophotographic type adopting an intermediate transfer belt.

This image forming apparatus comprises a sheet supplying unit 20, an optical unit 14 of a laser scanning exposure type, an image forming unit 10 comprising first to fourth image forming portions 1*a*, 1*b*, 1*c* and 1*d*, an intermediate transfer unit 30, a tandem fixing unit 40, etc.

The first to fourth image forming portions 1*a*, 1*b*, 1*c* and id of the image forming unit 10 are electrophotographic process mechanism portions similar to the first to fourth image forming portions 1*a*, 1*b*, 1*c* and 1*d* of the image forming apparatus of FIG. 1. By an image forming procedure similar to that of the image forming apparatus of FIG. 1, and by the operations of the image forming unit 10 and the optical unit 14, an unfixed full-color image is formed on the intermediate transfer belt 31 of the intermediate transfer unit 30. In a secondary transferring portion Te, the unfixed full-color image on the intermediate transfer belt 31 is collectively secondary-transferred to a transfer material P fed from a first sheet supplying portion 20*a* or a second sheet supplying portion 20*b* of the sheet supplying unit 20 to the secondary transferring portion Te. The transfer material P is conveyed to the tandem fixing unit 40.

The tandem fixing unit 40, as in Embodiment 1, has two heat-fixing devices, i.e., a first heat-fixing device 41*a* and a second heat-fixing device 41*b* installed more downstream than the first heat-fixing device 41*a* with respect to the transfer material conveying direction. Both of the first and second heat-fixing devices 41*a* and 41*b*, as in Embodiment 1, are heat roller fixing devices. A transfer material conveying guide 46 is disposed between the first heat-fixing device 41*a* and the second heat-fixing device 41*b*.

The internal constructions of the first heat-fixing device 41*a* and the second heat-fixing device 41*b* are similar to those in Embodiment 1, and the amount of generated heat of the second heat-fixing device 41*b* is set to a smaller amount than that of the first heat-fixing device 41*a*.

In the interior of the tandem fixing unit 40, the first heat-fixing device 41*a* is disposed near the secondary transferring portion Te, and the second heat-fixing device 41*b* is disposed on the downstream side with the respect to the transfer material conveying direction and above in a vertical direction with a conveying guide 46 interposed therebetween. Also, the first heat-fixing device 41*a* and the second heat-fixing device 41*b* are included in a heat exhaust duct 50 as an exhaust heat route, and an intake opening 51 for the atmosphere is disposed near the first heat-fixing device 41*a*, and a heat exhaust opening (exhaust opening) 52 is disposed further above the second heat-fixing device 41*b*.

According to the present construction, fixing hot air produced by the first heat-fixing device 41*a* rises along the interior of the heat exhaust duct 50 by natural convection, and arrives at the second heat-fixing device 41*b*. As in Embodiment 1, the first heat-fixing device 41*a* assumes a high temperature of 150 to 250° C. and therefore, the air around this first heat-fixing device 41*a* also has heat of 70 to 100° C. as fixing hot air and further the first heat-fixing device is substantially hermetically sealed by the heat exhaust duct 50 and therefore, the fixing hot air around the first heat-fixing device 41*a* arrives at the second heat-fixing device 41*b* almost without any loss. Thus, the second heat-fixing device 41*b* is heated from below by hot air of 70 to 100° C. produced by the first heat-fixing device 41*a*, and the amount of generated heat necessary for the second heat-fixing device 41*b* to reach a predetermined temperature (desirably 100 to 200° C.) can be suppressed to at least a half of that of the first heat-fixing device 41*a*.

As described above, again in the case of this Embodiment 2, the exhaust heat route (heat exhaust duct) 50 for the fixing hot air of the first heat-fixing device 41*a* is designed to pass via the second heat-fixing device 41*b* and to exhaust the fixing hot air of the first heat-fixing device 41*a* and the second heat-fixing device 41*a* and the second heat-fixing device 41*b* in one and the same exhaust heat route 50 through one and the same heat exhaust opening 52. Accordingly, as in the case of Embodiment 1, the hot air by the heat generation of one heat-fixing device 41*a* is utilized for the heat generation of the other heat-fixing device 41*b*, whereby two heat-fixing devices are used and yet, consumed electric power required for the heat generation of the heat-fixing devices can be suppressed to a low level and also, in the heat-fixing device 41*b* receiving the hot air, the heat generating device concerned in heat generation can be constructed on a small scale.

Also, the heat exhaust of the first heat-fixing device 41*a* and the second heat-fixing device 41*b* is effected by one and the same heat exhaust duct 50 and therefore, it is not necessary to provide heat exhaust ducts discretely for the respective heat-fixing devices, and this contributes to a decrease in the number of parts, the simplification of the layout of the interior of the image forming apparatus and the downsizing of the image forming apparatus.

Moreover, the utilization of the exhaust heat of one heat-fixing device 41*a* assists the temperature control of the other heat-fixing device 41*b* and therefore, the amount of heat exhausted from the image forming apparatus is relatively small, and this leads to the effect that the environment around the image forming apparatus is not aggravated.

Further, in the case of the present embodiment, the first and second heat-fixing devices 41*a* and 41*b* are disposed in the vertical direction, whereby the heat exhaust by natural convection is effected in the exhaust heat route (heat exhaust duct) 50 and therefore, the heat exhaust fan can also be eliminated, though as required, as in Embodiment 1, provision can be made of a heat exhaust fan and a suction fan for sucking the atmosphere.

According to the present embodiment, the hot air produced by the first fixing device is utilized for the heating of the second fixing device, whereby a plurality of heat-fixing portions are used and yet, consumed electric power required for the heat generation of the heat-fixing portions can be suppressed to a small amount and also, in the heat-fixing portion receiving the hot air, the heat generating device concerned in heat generation can be constructed on a small scale. Also, the heat exhaust of the first and second fixing devices is effected by one and the same exhaust heat route, whereby it is not necessary to provide heat exhaust ducts discretely for the first and second fixing devices, and this contributes to a decrease in the number of parts, the simplification of the layout of the interior of the image forming apparatus as well as the downsizing of the image forming apparatus. Moreover, the utilization of the hot air of the first fixing device assists the temperature control of the second fixing device and therefore, the amount of heat exhausted from the image forming apparatus is relatively small.

While the invention has been described with reference to the structure disclosed herein, it is not confined to the details set forth and this application is intended to cover such modifications or changes as may come within the purpose of the improvements or the scope of the following claims.

This application claims priority from Japanese Patent Application No. 2004-240904 filed on Aug. 20, 2004, which is hereby incorporated by reference herein.

What is claimed is:

1. An image forming apparatus comprising:

an image forming device configured to form a toner image on a recording medium;

a first fixing device including a first pair of rotating members configured to heat-fix the toner image formed on the recording medium therebetween, wherein a housing surrounds said first pair of rotating members;

a second fixing device including a second pair of rotating members configured to heat-fix the toner image on the recording medium therebetween which is heat fixed by said first fixing device, wherein the housing surrounds said second pair of rotating members;

an exhaust heat duct configured to exhaust heat out of said apparatus; and a fan configured to form an air flow in said exhaust heat duct, wherein said first fixing device and said second fixing device are provided within said exhaust heat duct, and said exhaust heat duct exhausts heat of said first fixing device through said second fixing device by the air flow.

2. An image forming apparatus according to claim 1, wherein said first fixing device is disposed below said second fixing device.

3. An image forming apparatus comprising:

an image forming device configured to form a toner image on a recording medium;

a first image heating device including a first pair of rotating members configured to heat-fix the toner image formed on the recording medium therebetween, wherein a housing surrounds said first pair of rotating members;

a second image heating device including a second pair of rotating members configured to heat-fix the toner image on the recording medium after it is heated by said first image heating device, wherein a housing surrounds said second pair of rotating members;

an exhaust heat duct configured to exhaust heat out of said apparatus; and a fan configured to form an air flow in said exhaust heat duct, wherein said first image heating device and said second image heating device are provided within said exhaust heat duct, and said exhaust heat duct exhausts heat of said first image heating device through said second image heating device by the air flow.

4. An image forming apparatus according to claim 3, wherein said first image heating device is disposed below said second image heating device.

* * * * *

UNITED STATES PATENT AND TRADEMARK OFFICE

CERTIFICATE OF CORRECTION

PATENT NO. : 7,391,987 B2
APPLICATION NO. : 11/202229
DATED : June 24, 2008
INVENTOR(S) : Sahara It is certified that error appears in the above-identified patent and that said Letters Patent is hereby corrected as shown below:

ON THE TITLE PAGE:
At Item (56), References Cited, Foreign Patent Documents, line 1, "JP 56104364 A * 8/1981" should read --JP 56-104364 A * 8/1981--, and line 7, "JP 2002062771 A * 2/2002" should read --JP 2002-062771 A * 2/2002--.

COLUMN 2:
Line 34, "a" (first occurrence) should be deleted.
Line 57, "and id" should read --and 1d--.

COLUMN 3:
Line 32, "about" should read --abut--.

COLUMN 4:
Line 51, "and id," should read --and 1d,--.

COLUMN 5:
Line 59, "source" should read --sources--.

COLUMN 7:
Line 52, "and id" should read --and 1d--.

COLUMN 8:
Line 19, "the" (second occurrence) should be deleted.

Signed and Sealed this

Second Day of December, 2008

JON W. DUDAS
*Director of the United States Patent and Trademark Office*